United States Patent [19]

Thom

[11] Patent Number: 4,881,971

[45] Date of Patent: Nov. 21, 1989

[54] REFINING OF LEAD-DEBISMUTHIZING

[76] Inventor: Michael J. Thom, 50 William Chadwick Drive, Eshowe, 3815, South Africa

[21] Appl. No.: 189,125

[22] Filed: May 2, 1988

[30] Foreign Application Priority Data

Feb. 3, 1988 [ZA] South Africa ..... 88/0749

[51] Int. Cl.[4] ..... C22B 13/08

[52] U.S. Cl. ..... 75/78; 75/108

[58] Field of Search ..... 75/78, 77, 108, 109

[56] References Cited

U.S. PATENT DOCUMENTS

| | | | |
|---|---|---|---|
| 2,194,441 | 3/1940 | Gilbert | 75/78 |
| 2,204,651 | 6/1940 | Betterton et al. | 75/78 |
| 2,402,316 | 6/1946 | Dittmer | 75/78 |
| 4,135,993 | 1/1979 | Um | 75/109 |
| 4,157,946 | 6/1979 | Hyvärinen | 75/108 |

OTHER PUBLICATIONS

Van Der Merwe, J. T. L., et al., The Debismuthing of Lead: A Review of Practise, 8/15/78.

Davey, T. R. A., Trans.AIME, 206, pp. 341–350 (1956).

Hey, J. D., et al., Development of a Continuous Process for the Fine Debismuuthing of Lead, undated.

Jollivet, L., et al., Journal of Metals, 3/64, pp. 235–237.

Rudiger, W., Erzmetall, 12/1974, Heft, 12, pp. 599–603.

Kuanysheva, K. S., et al., The Bulletin of the Bismuth Institute, Second Quarter, 12/1975.

Emicke, K., et al., AIME World Symposium 12, 1970 on Mining and Metallurgy of Lead and Zinc, vol. 2.

Smirnov, M. P., et al., Tsvetnye Metally No. 1, 12/1975, pp. 22–24 (translation).

*Primary Examiner*—S. Kastler

[57] ABSTRACT

A method of removing bismuth from lead wherein the lead is melted, barium is dissolved in the lead optionally with magnesium, calcium or strontium, the melt is cooled, and dross which contains barium is removed from the melt. The barium is preferably added as a barium lead alloy which is produced by electrolysis of a mixture of barium sulphide, barium fluoride and potassium fluoride.

6 Claims, 2 Drawing Sheets

REFINING OF LEAD-DEBISMUTHIZING

BACKGROUND OF THE INVENTION

Figure 1:
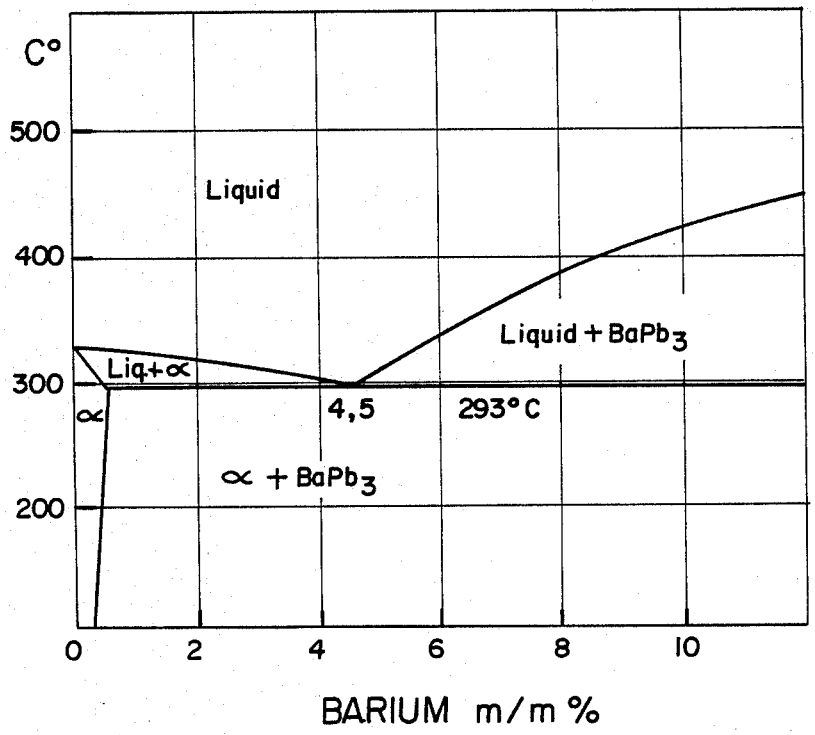

This invention relates to the debismuthizing of lead.

The applicant is aware of the Kroll process for removing bismuth from lead. This process involves the addition of approximately equal quantities of magnesium and calcium to the molten lead at 420° C., the slow cooling of the lead and removal of the dross formed; several drossings being carried out; and finally, the cooling of the lead almost to freezing point and the removal of the bismuth-rich crust from the surface.

Lead recovered from the crust is returned to the circuit and the bismuth recovered is purified.

The success of Kroll's process resulted from the fact that calcium and bimuth react to form calcium bismuthide $Ca_3Bi_2$ which has a high melting point and is fairly insoluble in lead.

The presence of magnesium further decreases the solubility of $Ca_3Bi_2$. Magnesium itself forms a high melting point bismuthide $Mg_3Bi_2$.

J. O. Betterton also did work on the debismuthizing of lead and a process very similar to Kroll's using calcium and magnesium is still in use in many parts of the world to this day. This process is known as the Betterton-Kroll and is probably the most favoured method in use at present. This process takes the bismuth content down to approximately 0.01% or 0.005% at best.

The Jolivet Process was developed to refine lead to bismuth levels as low as 10 parts per million or 0.001%. This was achieved by using potassium, usually after most of the bismuth had been removed by the use of calcium and magnesium.

Some refineries have considered potassium too dangerous a metal to store or work with and have abandoned the Jolivet process in favour of the Betterton-Kroll process.

Experiments have also been carried out with sodium and antimony but only the use of antimony seems to have found commercial use. At some refineries antimony is used in the final stages to take bismuth down to low levels.

An electrolytic process completely different in character from any of the preceeding was developed by Betts. The Betts process involves the electrolytic refining of lead containing bismuth and other impurities using as an electrolyte a solution of lead fluorosilicate and free fluorosilicic acid, the bismuth and other impurities remaining at the anode as a sludge. In reality it is a method of removing lead from its impurities in that lead is removed from an anode and deposited as pure lead on a cathode, as opposed to removing impurities from lead.

Finally, it should be noted that many variations of the Betterton-Kroll process are in use today but, in general, the original technology is still being used, and the debismuthizing of lead remains a relatively expensive operation.

SUMMARY OF THE INVENTION

The invention is concerned with an improved technique for removing bismuth from lead.

The invention, first and foremost, involves the use of barium in the removal of bismuth from lead.

The invention is however not limited to the use of barium on its own, for it relates also to the use of barium together with one or more reagents to improve the process' efficiency. Calcium and/or magnesium have been found to be particularly useful substances when used together with barium in the debismuthizing of lead.

It is also possible to make use of the metal strontium in concentration or as a trace for it is believed to aid in, or to be catalytic to, the formation of barium-magnesium bismuthides and barium-calcium bismuthides in molten lead.

Barium bismuthide, calcium bismuthide, strontium bismuthide and magnesium bismuthide are themselves only slightly soluble in lead that is just above its melting point i.e. at 330° C. All these bismuthides appear to be considerably more soluble in molten lead at 450° C. On the other hand the secondary and tertiary bismuthides, i.e. metallic compounds of bismuth together with two or more other metals, have lower solubilities in molten lead than do the simple bismuthides such as $Ca_3Bi_2$, $Mg_3Bi_2$ and $Sr_3Bi_2$. All the abovementioned bismuthides are much less dense than molten lead and rise to the surface of the bath upon cooling where they are removed in the form of a dross or crust.

It has been found through experimentation that barium alone, or together with strontium, and optionally with magnesium and/or calcium, is effective in removing bismuth from lead. Barium and magnesium at this stage of development appear to be the optimum pair.

Another aspect of the invention is that the barium is not necessarily added to the molten lead as barium metal but as an alloy of lead and barium. This alloy may contain from 3% to 6% barium and preferably from 4% to 5%. A suitable value is 4.5%. There is a considerable advantage in the use of an alloy of this type.

The invention is also concerned with the preparation of the lead barium alloy. There are four ways of doing this:

(1) By dissolving barium sulphide in a molten mixture of barium fluoride and potassium fluoride. Other mixtures in which appreciable amounts of BaS may be $Baf_2$- KC $+CaCl_2$; $BaF_2+CaF_2$; $BaF_2+CaCl_2+KCl$, and $BaF_2+KCl+NaCl$. The resulting molten electrolyte is then electrolysed in a cell using a graphite anode and a cathode of molten lead at 800° to 900° C. Sulphur vapour is evolved at the anode and is cooled and condensed to "flowers of sulphur". Barium reports at the cathode where it readily dissolves in the lead to produce the required alloy.

(2) The alloy may be produced chemically by the action of barium chloride on a molten sodium lead alloy. In practice a molten mixture of 80% $BaCl_2$ and 20% KCl (m/m) is stirred into molten lead containing 1% to 2% sodium at approximately 800° C. The following reaction takes place:

$$BaCl_2+Na/Pb=2NaCl+Ba/Pb$$

or $$BaCl_2+2Na=2NaCl+Ba.$$

These are equilibrium reactions but they are driven strongly to the right. The entire surface of the lead is covered by the molten salt mixture, protecting the barium and sodium from atmospheric oxidation. The reaction may also be considered as an ion exchange between the lead bath and the molten salt mixture. Sodium ions pass into the salts and barium ions pass into the molten lead. Traces of sodium remaining in the lead are not harmful but may be removed by removing the "used" salts containing NaCl and retreating with "fresh" $BaCl_2+KCl$ low in NaCl. Similar reactions occur with Li and K lead alloys.

(3) The alloy may be prepared by dissolving metallic barium in molten lead but this results in high losses and is expensive.

(4) The alloy may be prepared by electrolysing a mixture of $BaCl_2+KCl$: $BaCl_2+CaCl_2$; or $BaCl_2+NaCl$, using a graphite anode and a cathode of molten lead at approximately 800° C.

Of the various methods referred to the electrolysis of barium sulphide is attractive because it requires much less energy than the electrolysis of $BaCl_2$ or $BaF_2$, as can be gauged from the heats of formation of these compounds.

TABLE 1

| SALT | Hf° k. cals/mole | DECOMPOSITION VOLTAGE Hf° 23060n |
|---|---|---|
| $BaF_2$ | −286.9 | 6.22 |
| $BaC_2$ | −205.56 | 4.46 |
| BaS | −106.0 | 2.30 |

Barium sulphide requires only 52% of the energy that an equivalent amount of barium chloride requires to electrolyse. The actual saving results from the fact that the electrolytic cell operates at a much lower voltage for barium sulphide.

A feature of the sulphide electrolysis is that some of the sulphur produced can be used to remove copper from the unrefined lead.

An interesting feature of the invention is that the mineral barytes, $BaSO_4$, is often found in association with galena. Barium sulphide may be produced directly from barytes by reducing it with carbon (coke) at 1000° C. in a rotary furnace, $$BaSO_4+4C \rightarrow BaS+CO$$

Traces of strontium are usually found in the barytes and undergo the same reaction. The SrS that reports together with the BaS is beneficial and is not harmful.

The possible production of a barium lead alloy from barytes is a feature of this invention for beneficial traces of strontium may be obtained without having to buy the metal which is expensive. As has been pointed out barium lead, with or without strontium, may be used in the debismuthizing process.

This invention is not limited to the use of barium as the major refining element but also covers techniques where barium is a minor reagent. For example a lead alloy containing calcium with a little barium or an alloy of lead containing strontium with a little barium may be used In the debismuthizing process this alloy together with magnesium is added to the lead, typically at 420° C. The magnesium may be added before, after or together with the Pb/CaBa or Pb/Sr/Ba alloy.

One of the most interesting aspects of the invention is that the metals used do not have to be pure. An alloy of Ba, Sr, Ca together with traces of Na and K may be used where either Ba, Sr or Ca may be the major alloying constituent. Therefore in the preparation of the barium lead "master-alloy" mentioned above a mixture of salts may be used either in the chemical or electrolytic method. For example in the laboratory it has been noted when an electrolyte comprising 90% $BaCl_2$ and 10% $CaCl_2$ is electrolysed using lead as a cathode a barium lead alloy is obtained. However using an electrolyte of 90% $CaCl_2$ and 10% $BaCl_2$ an alloy of calcium lead is obtained. When KCl is added to the electrolyte as well, e.g. 80% $BaCl_2$, 10% $CaCl_2$ and 10% Cl only traces of potassium report in the Ba/Pb alloy produced. Typically the ratio of barium to potassium is between 100 and 1000. However, KCl or NaCl reduces the melting point of the electrolyte. LiC is even more effective in this respect and has the added advantage of considerably improving the electrical conductivity of the molten salt bath, but it is very expensive. It is possible to choose a composition of electrolyte to give virtually any desired ratio of Ba to Ca in the resulting "master-alloy".

Applying the technique of mixed salts to the treatment of sodium lead the same results (approximately) may be obtained:

$$BaCl_2 + CaCl_2 + KCl + \underset{\text{Sodium lead}}{(Na/Pb)} \longrightarrow NaCl + \underset{\text{"master alloy"}}{(Ba/Ca/Pb)}$$

The Ba/Ca/Pb master alloy so produced will naturally contain more sodium than an alloy produced by the electrolytic method. The "master alloy" produced by any of the preceding techniques may be used in ingot form or in the molten state when added to lead which is to be debismuthized.

EXAMPLE

An example of the debismuthizing process is now described.

150 Kg of magnesium ingots is added to a kettle containing 100 metric tons of lead (0.20% Bi) at 425° C. The lead is stirred until the magnesium, which represents about 15% of the mass, has dissolved. A total of 4.4 tons of molten lead containing 4.5% barium is then added and the mixture stirred for one minute or less. This barium is approximately 0.2% by weight, of the melt. The alloy may be added at a temperature as low as 300° C. Alternatively five tons of "master-alloy" ingots of about 4% Ba is added, with stirring. The addition of the large amount of barium lead, or "master-alloy", helps to reduce the temperature of the bath. Stirring is kept to a minimum.

The bath is then slowly cooled and drossed at 400° C., 375° C., and 350° C. and finally any dross or crust formed is removed at approximately 330° C., just above the melting point of lead.

Most of the bismuth and barium reports in the dross and is thus removed together with the magnesium. Any barium and magnesium remaining in the lead may be removed at a later stage by oxidation with a mixture of $NaNO_3$ and $NaOH_3$, which is a standard procedure.

The barium lead alloy used may be prepared from unrefined lead containing bismuth or from pure lead. A level of 0.1% to 0.3% Bi in the "master-alloy" does not affect the process. The lead used to prepare this alloy should however contain less than 0.01% Sb and As as these form insoluble compounds with barium.

A variation of the above procedure is to tap off the molten lead at approximately 330° C. leaving the bismuth-rich crust and dross behind. This process reduces the bismuth content to between 0.01% and 0.005%.

In trials a single drossing using Mg and Ba reduced the bismuth level from 1500 p.p.m. to 90 p.p.m. in less than 3 hours.

Any bismuth remaining after treatment with barium may be removed using potassium (Jolivet process) or antimony.

The invention is not limited to this specific example. For example it may be advantageous to add the barium lead alloy in stages at various temperatures taking advantage of the fact that 4.5% barium lead alloy melts at only 293° C.

A 6% Ba alloy melts at only 340° C. This gives barium a considerable advantage over calcium as it may be added to the bath at a much lower temperature resulting in lower losses.

FIG. 1 is a phase diagram of barium in lead. This diagram indicates that the melting point of Pb/Ba decreases with increasing barium content up to the eutectic mixture at 4.5% Ba. Only above 4.5% Ba does the melting point begin to increase Alloys containing up to 10% barium may be used in debismuthizing. This is not the case with calcium lead alloys.

Figure 2:
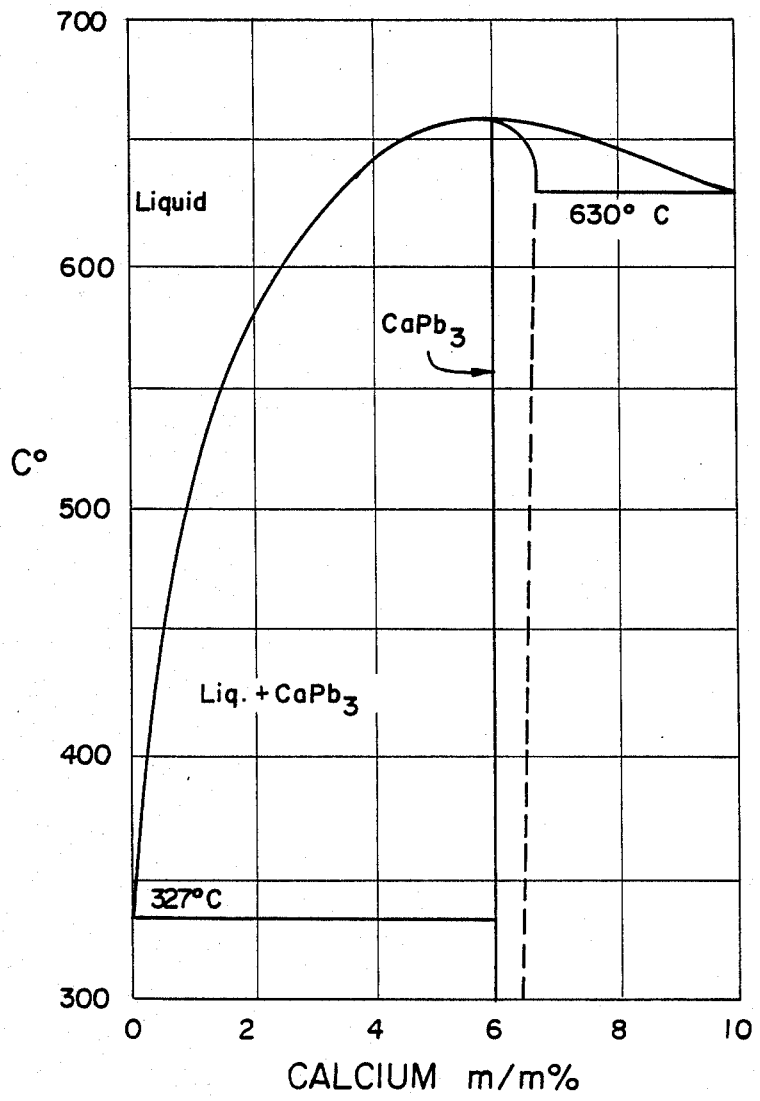

FIG. 2 is a phase diagram of calcium in lead and illustrates how rapidly the melting point of such an alloy increases with increasing calcium content. Even an alloy of only 1% calcium in lead melts at 510° C. while 4.5% alloy melts at 650° C. Ingots of lead containing 4% to 5% calcium will dissolve in lead at 400° C. but not as readily as a 4.5% Ba/Pb ingot. However, the barium alloy can be added in liquid form at 300° C.

In conclusion it should be noted that at present the preferred modus operandi is to use magnesium and barium, but as research continues various mixtures of strontium and/or barium with one or more of the following may prove superior; calcium, magnesium, potassium and sodium. For this reason the invention has been described in its broadest terms.

I claim:

1. A method of removing bismuth from lead which includes the steps of dissolving barium sulfide in a molten mixture of at least two of $BaCl_2$, $BaF_2$, $CaCl_2$, $CaF_2$, KCl and NaCl; electrolyzing the mixture using a molten lead cathode; collecting a barium alloy at the cathode, adding the barium alloy to a molten bath of the lead, cooling the melt, and removing bismuth-containing dross from the melt, or tapping molten lead from the melt, thereby leaving the dross behind.

2. A method of removing bismuth from lead which includes the steps of producing a barium lead alloy by adding barium chloride to a molten sodium, lithium or potassium lead alloy, adding the barium lead alloy to a molten bath of the lead, cooling the melt, and removing the bismuth-containing dross from the melt, or tapping molten lead from the melt, thereby leaving the dross behind.

3. A method according to claim 1 or 2 wherein, in addition to the barium, one or more of the following are added to the melt: calcium, magnesium and strontium.

4. A method according to claim 1 or 2 wherein the barium content of the alloy is from 3% to 6%.

5. A method according to claim 1 or 2 wherein the molten lead temperature is initially above 400° C., and the melt is slowly cooled to about 330° C., and dross is removed from the melt when its temperature reaches predetermined values between 400° C. and 330° C.

6. A method according to claim 1 or 2 wherein approximately 0.15% by weight of magnesium is dissolved in the melt, and the barium-lead alloy contains approximately 0.2% by weight of the melt of barium.

* * * * *